United States Patent [19]

Gray

[11] 4,068,830

[45] Jan. 17, 1978

[54] MIXING METHOD AND SYSTEM

[75] Inventor: Joseph B. Gray, Wilmington, Del.

[73] Assignee: E. I. Du Pont de Nemours and Company, Wilmington, Del.

[21] Appl. No.: 430,756

[22] Filed: Jan. 4, 1974

[51] Int. Cl.[2] ..... B01F 15/02; B01F 5/10

[52] U.S. Cl. ..... 366/174; 366/176; 366/339; 366/340

[58] Field of Search ..... 259/4, 18, 36, 7, 8, 259/DIG. 30, 5, 6; 48/180 R, 180 B, 180 S, 180 M; 138/38

[56] References Cited

U.S. PATENT DOCUMENTS

| | | | |
|---|---|---|---|
| 1,496,345 | 6/1924 | Lichtenthaeler | 259/4 |
| 2,125,245 | 7/1938 | McCray | 259/4 AB |
| 2,312,639 | 3/1943 | Gronemeyer | 259/4 R |
| 3,286,992 | 11/1966 | Armeniades | 259/4 |
| 3,544,290 | 12/1970 | Larson | 48/180 B |
| 3,861,652 | 1/1975 | Clark | 259/4 AB |

*Primary Examiner*—Robert W. Jenkins

[57] ABSTRACT

A mixing method and system for the thorough intermixing of liquids of widely different viscosities in which there is interposed at least one perforated plate in the line of flow ahead of a conventional static mixer.

2 Claims, 11 Drawing Figures

Fig. 1.
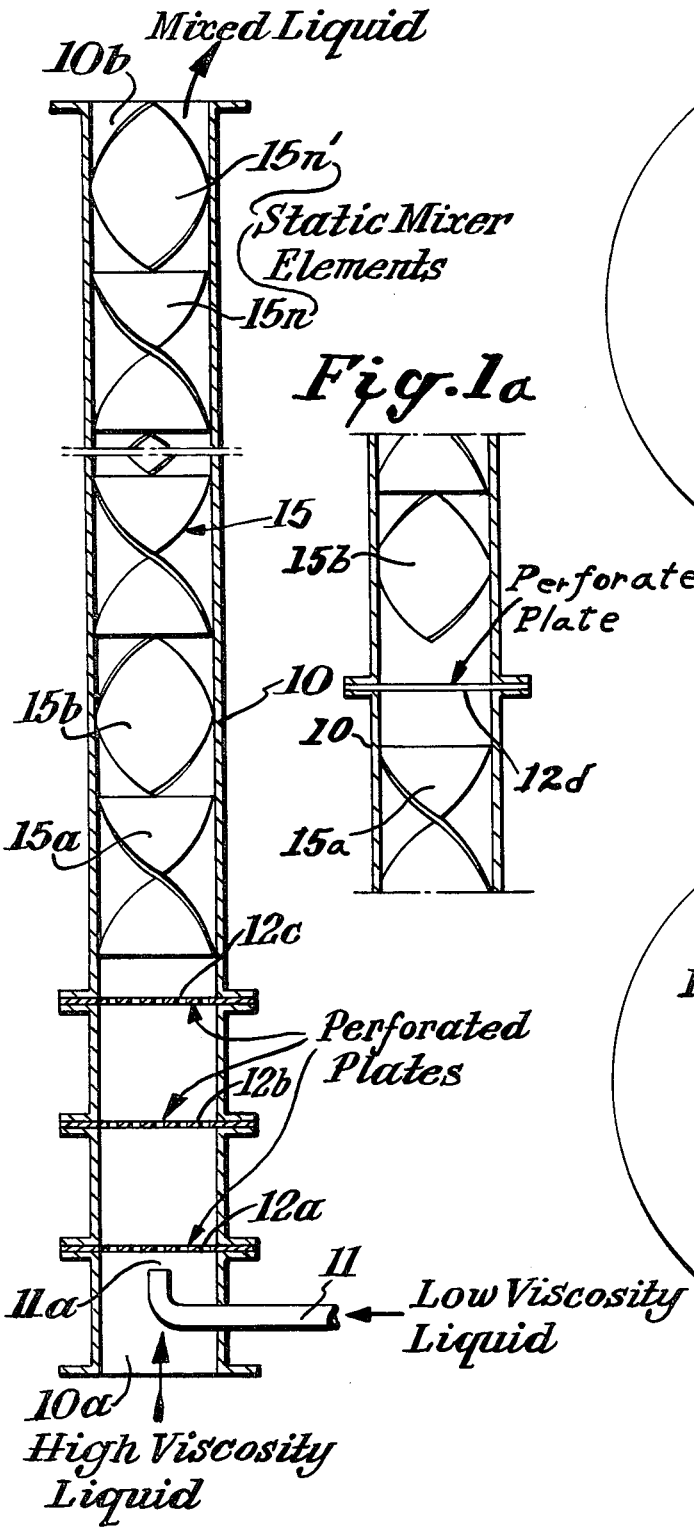
Fig. 1a
Fig. 2.
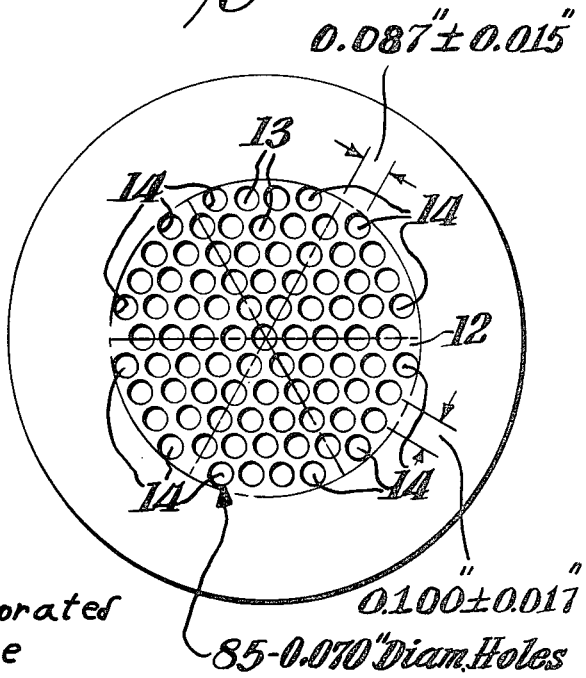
Fig. 3.
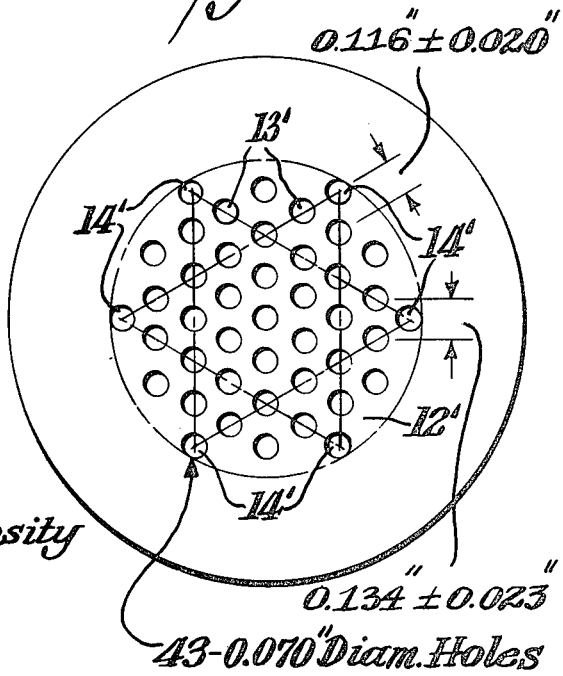

MIXING METHOD AND SYSTEM

CROSS REFERENCE TO RELATED APPLICATION

The subject matter of this Application relates to the invention of Application Ser. No. 306,921, filed Nov. 15, 1972, now U.S. Pat. No. 3,861,652, of common assignment.

BRIEF SUMMARY OF THE INVENTION

Generally, this invention comprises a mixing method and system for liquids of widely different viscosities incorporating one or more perforated plates interposed in the line of flow of the liquids during their supply under pressure to conventional mixing apparatus of static design.

DRAWINGS

The following drawings detail a preferred embodiment of the invention and the physical principles of operation, wherein:

FIG. 1 is a partially schematic longitudinal sectional view of a preferred embodiment of apparatus constructed according to this invention for the mixing of two liquids of widely different viscosities in which three perforated plates in series were utilized in conjunction with a plurality of static mixer elements, FIG. 2 is a plan view of a preferred design of perforated plate for the apparatus of FIG. 1, FIGS. 3 and 4 are plan views of second and third alternative designs of perforated plates utilized as elements for the apparatus of FIGS. 1 and 2 to obtain an operational comparison with the FIG. 2 plate design, and FIGS. 5–10, inclusive, are plan views of additional designs of perforated plates which were all tested and found to be of varying effectiveness as hereinafter reported.

DETAILED DESCRIPTION

Figure 4:
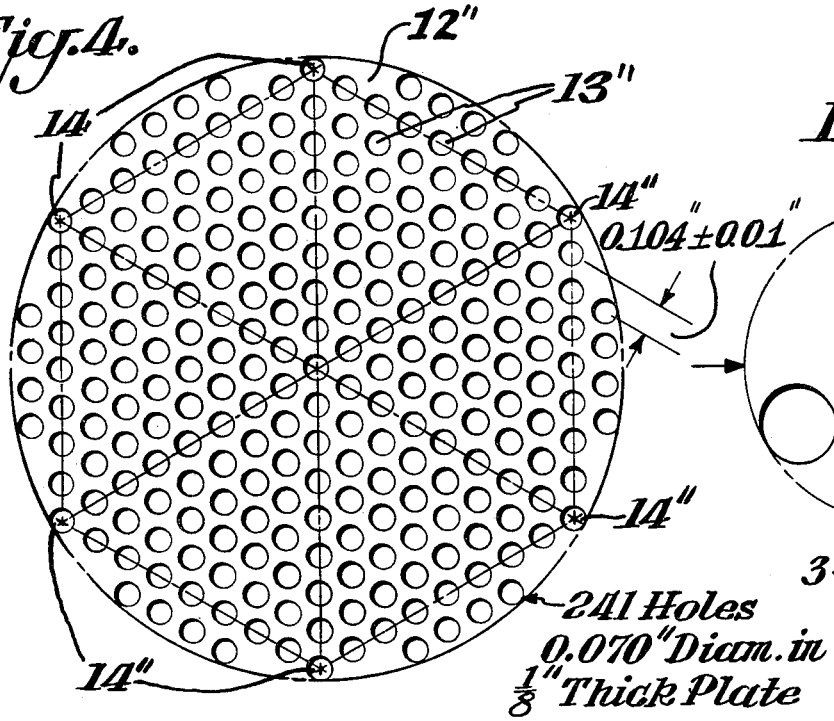
Figure 5:
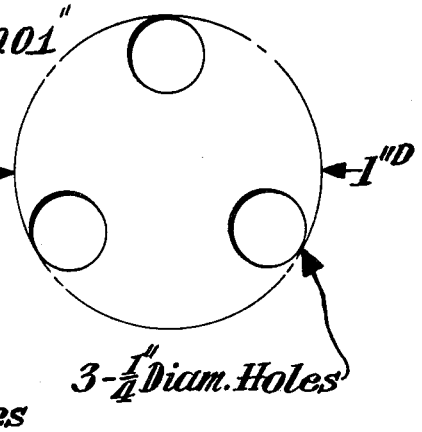
Figure 6:
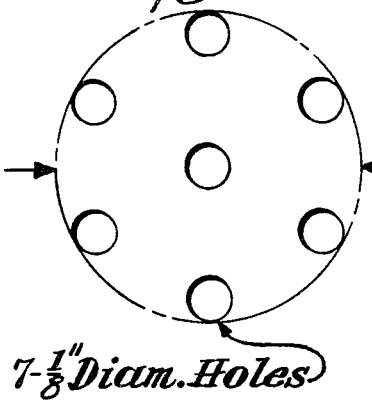
Figure 7:
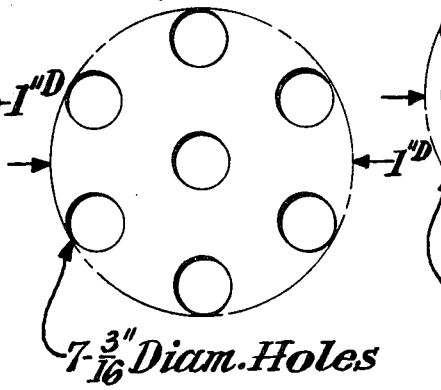
Figure 8:
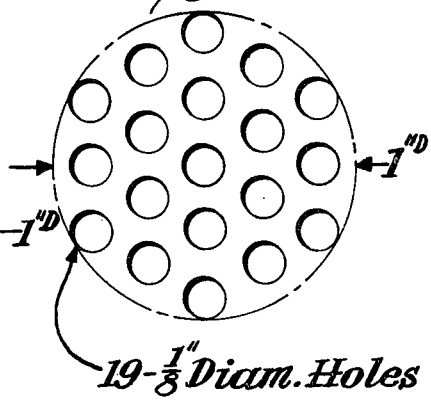
Figure 9:
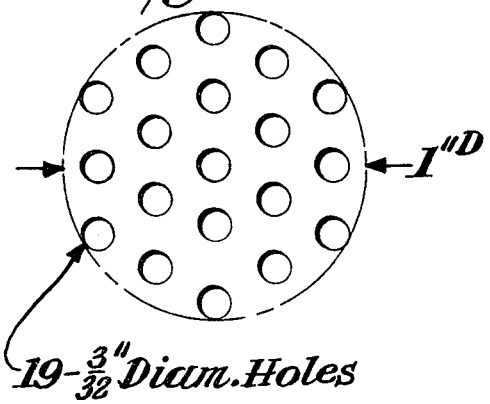
Figure 10:
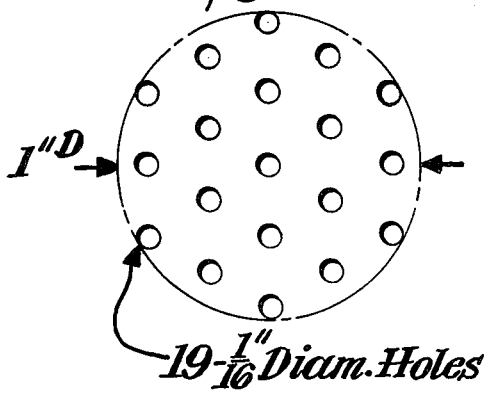

Continuous mixing of widely different viscosity liquids, and gases with liquids, is difficult to achieve. A wide variety of dynamic (power-driven) mixers have been employed in this service, including multiple-blade turbines, multistage helical ribbon designs, torpedo designs, and two-shaft, wiped surface mixers. Such mixers are relatively expensive and, for very intimate mix uniformities, require lengthy periods of operation and high power consumption.

Recently, various designs of static mixers have become available commercially, these including warped deflection plate types such as those disclosed in Armeniades et al. U.S. Pat. No. 3,286,992 and Potter U.S. Pat. No. 3,635,444, which operate by successive stream division followed by a folding recombination of ingredients. The static mixers are less expensive in first and operational costs but they, too, have been less than completely effective, especially unless used in large numbers in series flow circuit.

I have now discovered that very substantial mixing advantages can be obtained by interposing one or more perforated plates in series flow disposition with respect to the fluids to be mixed while they are fed under pressure to static mixing apparatus.

Referring to FIG. 1, a preferred embodiment of system according to my invention, utilizing static mixer elements of the general design taught in U.S. Pat. Nos.

3,286,992 and 3,635,444 supra, comprises a tubular flow conduit 10 which is supplied at entrance and 10*a* with the high viscosity liquid to be mixed from a pump or other pressure source not shown. The low viscosity liquid component is supplied under pressure through a line 11 terminating in a discharge outlet 11*a* oriented generally axially of conduit 10 with its vent opening downstream of the flow of high viscosity liquid.

In the system of FIG. 1 three perforated plate elements 12*a*, 12*b* and 12*c* are utilized in series arrangement spaced approximately one conduit 10 diameter apart, with the first perforated plate, 12*a*, disposed approximately 0.5 to 2.0 conduit 10 diameters downstream from the vent 11*a* of conduit 11. For convenience in mounting the perforated plates 12*a*, 12*b* and 12*c*, flanged sections of conduit were assembled in prolongation one with another as shown in FIG. 1 to provide the continuous flow conduit 10 in the plate region.

Deferring description of the plate perforation details until later, the static mixer elements disposed in seriatim one with another and with perforated plates 12*a*, 12*b* and 12*c* consist of 20 to 30 warped plate pairs 15*a*, 15*b* to 15*n*, 15*n'*, alternate members of each pair having opposite directions of twist, mounted fixedly in place within conduit 10 with the entrance end of the first static mixer pair preferably spaced not more than about 10 conduit 10 diameters downstream from the last perforated plate element 12*c*. After traversing the last plate pair, 15*n*, 15*n'*, the intimately combined liquid mixture discharges from the system via outlet 10*b*.

Turning now to FIG. 2, an actual design of perforated plate element 12, which in this instance was a 1inch diameter perforated area size (surrounded by an annular flange section of 2 inch outside diameter), consisted of a ⅛inch thick steel plate provided with 85 holes 13 each 0.07 inch in diameter spaced uniformly at center-to-center distances of 0.100 inch ±0.017 inch taken parallel with respect to lines inclined 60° counter-clockwise from the horizontal and 0.0867 inch ±0.015 inch taken normally with respect to lines drawn 60° counter-clockwise with respect to the horizontal. The twelve holes denoted 14 were each approximately tangent to the inside wall of conduit 10 which, for the design portrayed, had a 1 inch inside diameter.

A less preferred alternate design of perforated plate 12' is detailed in FIG. 3, wherein the construction is generally the same as for FIG. 2, consisting again of a ⅛inch thick steel plate provided, in this instance, with 43 holes 13', 0.07 inch diameter, distributed in alternate rows along the ordinate at 0.134 inch hole-to-hole vertical spacing and at 60° inclination 0.116 inch ±0.020 inch spacing. Six holes 14' were disposed tangent to the inside wall of the conduit 10 which, for this design, also was 1 inch inside diameter.

An oversize perforated plate 12 inches is detailed in FIG. 4, this being a 2 inch diameter perforated area (4 inches outside diameter flange size) ⅛ inch thick steel plate provided with 241 drilled holes, each 0.07 inch diameter, spaced 0.120 inch between hole centers and 0.104 inch ±0.01 inch between adjacent parallel rows of hole centers the six holes denoted 14 inches being tangent to the supply conduit 10 which, in this instance, was 2 inches inside diameter. This perforated plate was provided immediately downstream with a 4 inch transition length conventional pipe reducer, not shown, constricting the flow to 1 inch prior to introduction into static mixers 15*a*, 15*b* – 15*n*, 15*n'* for the comparative performance tests hereinafter reported.

Additional designs of perforated plates (of thicknesses reported in TABLE I) had hole dispositions and sizes as indicated in FIGS. 5–10, respectively, as to which all perforated area diameters were 1 inch diameter, some plates being of 2 inches outside diameter flange design, whereas others were secured, in place in the flow conduit by cementing around the peripheries, none of this detail being further provided because it has no bearing on the operation of the perforated plates.

The mixing action of apparatus constructed according to this invention, using glass conduits 10 permitting visual observation of the mixing obtained, appears to be as follows: Perforated plates 12, 12' and 12" divide the single stream of low viscosity liquid into many smaller streams and thus greatly increase the interfacial area between the low and high viscosity liquids. Downstream of each perforated plate 12 there is created a multiplicity of wakes in which the pressure is lower than that in the liquid more remote from these wakes. The low viscosity liquid preferentially accumulates in the flow wakes and, moreover, the lower viscosity liquid appears to be able to move laterally across the higher viscosity liquid streamlines within the wakes. The lower viscosity liquid leaves the wakes in sheets or threads where streamlines of high viscosity liquid meet again downstream of the wakes.

From the foregoing, it will be understood that perforated plates 12 provide preliminary break-up, subdivision and distribution of low viscosity liquids in high viscosity liquids. Completion of the mixing of the liquids to obtain a uniform effluent, when they are miscible or soluble, is dependent on molecular diffusion plus the action of subsequent mixing devices such as the static laminar mixers hereinafter described.

My tests have revealed the following:

1. The plan view shapes of holes 13, 13', 13" can be widely varied: circular, square, triangular, hexagonal and other configurations being all operable; however, circular holes are preferred because of ease of fabrication.

2. Hole diameters can be anywhere in the range of about ¼ to 1/100 of the conduit 10 diameter; however, ⅛ to 1/32 is preferred.

3. The ratio of total cross-sectional area of all holes 13, 13', 13" divided by the cross-sectional area of conduit 10 can be from about 1/20 to about ¾, but ⅓ to ½ is preferred.

4. The number of plates 12 utilized can range from one to about ten, with two to four being preferred.

5. Plates 12 can be disposed all upstream of the mixers, or they can be interspersed between successive mixer elements, such as the ones denoted **15*a*, 15*b* – 15*n*, 15*n'*, FIG. 1. If the plates 12 are located upstream from the mixers, the spacing between adjacent plates should be in the range of about ¼ to about 10** conduit 10 diameters, with 1–3 diameters being preferred.

6. The supply of lower viscosity liquid to be mixed can be via one or more holes in a conventional distributor ring, but a single injection tube such as that detailed at 11, **11*a*, FIG. 1**, is preferred.

7. The distance between the lower viscosity liquid injection point and the first downstream perforated plate 12 should be in the range of about ⅛ to 10 or more conduit 10 diameters, with ½ to 2 diameters preferred.

8. Mixing according to this invention is effective where the proportion of low viscosity liquid to be mixed with high viscosity liquid is in the volumetric flow ratio range of about 0.01 to 0.2, and where the ratio of viscosities of high viscosity liquid to low viscosity liquid is in the range of about $4 \times 10^3$ to $10^6$.

A vertically oriented test apparatus was constructed generally resembling that shown in FIG. 1. Corn syrup (Corn Products Co. Code 1132) was utilized as the high viscosity liquid to be blended, this material having a viscosity of 1050 poises at 20° C. and 450 poises at 30° C. Water dyed with 0.5 gm of methylene blue for each 5 gallons volume was utilized as the low viscosity liquid.

The corn syrup was stored in a 30 gal. Binks tank under air pressure, which could be adjusted to vary the corn syrup flow rate. The syrup was supplied to the apparatus via an 18 inch long horizontal 1 inch dia. pipe, thence through a pipe tee and vertically upwards for 12 inches of 1 inch dia. pipe to the first perforated plate 12.

The dyed water was stored in a 5 ga. Binks tank under air pressure. A rotameter and needle valve were used to adjust and measure the water flow rate. Water was injected into the syrup through a ⅛ inch outside diameter, 1/16 inch inside diameter tube pointed upwards (i.e., downstream) near the center of the syrup flow pipe 10. The point of water injection was 1 inch to 2 inches upstream of the first perforated plate 12. After the sixteenth test tabulated in the following TABLE III, i.e., after Test 2-7-14, the feed tanks were wrapped with ¼ inch tubing for circulation of constant temperature water, and then encased in insulation.

Perforated plates 12, disposed transverse conduit 10, were followed downstream by static spiral mixers of the Kenics Static® design, which generally resembled those disclosed in U.S. Pat. No. 3,286,992 supra, arranged in series sequence up conduit 10. Four, four-element edgesealed Kenics® modules were employed in most of the mixing tests herein reported. The mixer elements were fabricated from stainless steel, whereas conduit 10 was 1 inch i.d. glass.

The effluent flow rate discharged from outlet **10*b*** was determined by weighing the effluent for a measured period of time.

The characteristics of the perforated plates 12 utilized are given in TABLE I, with typical hole arrangements shown in FIGS. 2–10, inclusive. The characteristics of any screens employed in supplementation are given in TABLE II.

TABLE I

| PERFORATED PLATE DIMENSIONS | | | | | | | | | |
|---|---|---|---|---|---|---|---|---|---|
| Hole diameter, in. | 1/4 | 3/16 | 1/8 | 3/32 | 1/16 | 0.070 | 0.070 | 0.070 | 0.070 |
| Drawing FIGURE | 5 | 7 | 8 | 9 | 10 | 3 | not shown | 2 | 4 |
| Number of holes | 3 | 7 | 19 | 19 | 19 | 43 | 61 | 85 | 241 |
| Plate diam.*, in. | 1 | 1 | 1 | 1 | 1 | 1 | 1 | 1 | 2 |
| Fraction open area | 0.19 | 0.25 | 0.30 | 0.17 | 0.07 | 0.21 | 0.30 | 0.44 | 0.30 |
| Thickness, in. | 1/8 | 1/8 | 1/8 | 1/8 | 1/8 | 0.04 | 0.04 | 0.04 | 1/8 |

*Diameter of circle tangent to outer holes.

TABLE II

| WIRE SCREENS | | | | |
|---|---|---|---|---|
| Mesh | 35 | 60 | 150 | 270 |
| Wire diameter, in. | 0.012 | 0.009 | 0.0026 | 0.0016 |

TABLE II-continued

| | WIRE SCREENS | | Syrup | |
|---|---|---|---|---|
| Weave | Plain | Plain | Plain | Twill |
| Opening, in. | 0.017 | 0.008 | 0.004 | 0.002 |
| Fraction open area | 0.34 | 0.21 | 0.37 | 0.32 |

TABLE III

| Test No. | Equipment | Syrup Temp. (° C.) Viscosity, poises | Per Cent Water in Effluent | Effluent Rate (lbs/hr) Viscosity, poises | Total Apparatus Pressure Drop, ΔP, p.s.i. | Observations |
|---|---|---|---|---|---|---|
| 1-6-30 | 20 Kenics® Mixer elements in a 1" glass pipe. No perforated plates. | (31) 385 | 0.6 | (42) — | — | A few 1/16" water globules were observed in the effluent. |
| 2-6-30 | " | | 2.1 | (47) — | 21 | 1/8"-1/4" water globules in the effluent. |
| 1-7-3 | In series, in 1" glass pipe: A perforated plate thick provided with 3-1/4" holes (FIG. 5) + 4 Kenics® elements + a perforated plate with 7 1/8" holes (FIG. 6) + 4 Kenics® elements + a perforated plate with 19 1/8" holes (FIG. 8) + 12 Kenics® elements. | (31) 385 | 9.8 | (42.7) 12 | 10 | A few 1/8" water globules were observed after 10 Kenics® elements, but mostly striations. No water globules and only a few trace striations observed after 20 Kenics® elements. |
| 2-7-3 | In series, in 1" glass pipe: A perforated plate 1/8" thick provided with 3-1/4" holes (FIG. 5) + 4 Kenics® elements + a perforated plate with 7 1/8" holes (FIG. 6) + 4 Kenics® elements + a perforated plate with 19 1/8" holes (FIG. 8) + 12 Kenics® elements. | (31) 385 | 2.5 | (41.4) 94 | 14.5 | No water globules and very attenuated striations observed after 14 Kenics® elements. No striations seen after 20 Kenics® elements. |
| 1-7-5 | In series in a 1" glass pipe: One perforated plate thick, provided with 19 1/16" (FIG. 10) holes + 16 Kenics® elements. | | 15.3 | (27.5) | 48 | Water spread across all of down stream side of plate. Channeling was observed thru first 8 Kenics® elements. Water globules reformed. Extreme striations and water globules after 16 elements. |
| 2-7-5 | In series in a 1" glass pipe: One perforated plate 1/8" thick provided with 19 1/16" (FIG. 10) holes + 4 Kenics® elements + one perforated plate with 19 1/8" holes (FIG. 8) + 12 Kenics® elements. | | 15 | (27) | 48 | Same as Test #1-7-5, except that water globules did not reform. |
| 1-7-7 | In series in a 1" glass pipe: Three perforated plates having (1) 3 1/4" holes (FIG. 5), (2) 7 3/16" holes (FIG. 7), (3) 19 1/8" holes (FIG. 8) + 16 Kenics® elements. | | 10 | (42) | 19 | Same observations as Test 1-7-5. |
| 1-7-11 | 4 Perforated plates each having 19 1/8" holes (FIG. 8), plates spaced 1" apart + 16 Kenics® elements. | 400 (approx.) | 8.1 | (51.6) | 13 | Water layer seen downstream of each plate. Channeling occurred after first 4 Kenics® elements. No channeling in 9th-12th elements. Weak striations observed after 12th element. |
| 2-7-11 | " | 400 (ap- | 2.2 | (48.5) | 16 | No segregated water |

TABLE III-continued

| Test No. | Equipment | Syrup Temp (° C.) Viscosity, poises | Per Cent Water in Effluent | Effluent Rate (lbs/hr) Viscosity, poises | Total Apparatus Pressure Drop, ΔP, p.s.i. | Observations |
|---|---|---|---|---|---|---|
| | | prox.) | | 150 | | seen after 4th plate. No channeling in Kenics® elements. No striations observed after 8th element. |
| 3-7-11 | Same apparatus as Test 1-7-11, except that 3/32" holes (FIG. 9) were substituted. | (26) 400 (approx.) | 2.4 | (43.3) 177 | 17 | Same observations as Test 2-7-11. |
| 4-7-11 | Same apparatus as Test 1-7-11, except that 3/32" holes (FIG. 9) were substituted. | 400 (approx.) | 8.4 | (50.2) 22 | 12 | No channeling in Kenics® elements. Very weak striations observed after 12th element. |
| 1-7-12 | " | (26) 400 (approx.) | 8.8 | (47.5) 24 | 16 | Same observations as Test 4-7-11. |
| 2-7-12 | " | (27) 400 (approx.) | 9.6 | (23.4) 20 | 9 | Same observations as Test 4-7-11, except that syrup fragments were detected in 12th element effluent. |
| 1-7-13 | Same apparatus as Test 3-7-11, except that 61 0.07" holes were substituted. | (26) 400 (approx.) | 9.2 | (45.8) 25 | 13 | 1/8" water layer observed on backsides of 3rd and 4th plates. There was some channeling in first 4 Kenics® elements. 1/32"–1/16" syrup fragments observed after 12 elements. |
| 1-7-14 | Same apparatus as Test 3-7-11, except that 61 0.07" holes were substituted. | (25) 400 (approx.) | 2.3 | (45.7) 138 | 19 | 1/16" water layer on third plate but none on fourth. No channeling in Kenics® elements. No syrup fragments after 12 elements. |
| 2-7-14 | Same apparatus as Test 1-7-14, except that perforated plates were spaced 6" apart. | 400 (approx.) | 2.3 | (46.5) | 15 | No water on first plate, <1/8" on third and none on fourth. No channeling in Kenics® elements. No striations or syrup fragments after 8th element. |
| 1a-8-3 | Four plates with 19 1/8" holes in each (FIG. 8) followed by 16 Kenics® elements. | (20) 1046 | 7.8 | (25.4) 27 | 9 | Water layers on 4 plates. Channeling after 4th plate and for 4 Kenics® elements. No syrup fragments after 16 Kenics® elements. Occasional water globules after 16 Kenics® elements. |
| 2-8-3 | Four plates with 61 0.07" dia. holes in each + 16 Kenics® elements. | (20) 1046 | 9.1 | (46.0) 22 | 17 | Less channeling, less pulsing, smaller scale nonuniformities than those in Test 1a-8-3. 1/32" syrup fragments after 16 Kenics® elements. No globules. |
| 1c-8-3 | Same as 1a-8-3 | (20) 1046 | 4.5 | (26.6) 60 | 9 | No pulsing above 4th plate. Striations but no syrup fragments after 16th Kenics® element. No water globules after 16th element. |
| 1-8-25 | Three perforated plates, 4" separation, | (20) 1046 | 11.5 | (48.8) — | 17 | Good water distribution across whole of of first 2" plate. 1/4" water layer on |

TABLE III-continued

| Test No. | Equipment | Syrup Temp (° C.) Viscosity, poises | Per Cent Water in Effluent | Effluent Rate (lbs/hr) Viscosity, poises | Total Apparatus Pressure Drop, ΔP, p.s.i. | Observations |
|---|---|---|---|---|---|---|
| | 241 0.07" holes in each (FIG. 4), 2" dia. tubing + 16 Kenics® elements in 1" pipe. | | | | | 1st plate, 1/8" on 2d, none on 3d. No water pulsing above 2d plate. 1/32" syrup fragments and Kenics® elements. |
| 1-9-27 | Four 43 hole (0.07" dia) plates, spaced 2" apart, followed by 16 Kenics® elements. | (20) | 7.1 | (26.2) — | 36 | Relatively uniform water distribution past plates, without pulsing above any plate. No channeling in Kenics® elements. A few 1/16"-1/8" syrup fragments after 16 elements. |
| 2-9-27 | Same as Test 1-9-27 except 85 0.07" holes used in all plates. | (20) 1046 | 6.8 | (27.3) — | 24 | Some maldistribution on 1st plate, cleared up after 3d plate. Many 1/32-1/16" syrup fragments after 16th Kenics® element. Syrup jets above 1st plate didn't "snake" as much as those in Test 1-9-27. |
| 4-9-27 | Four 85 hole (0.07" dia) plates followed by 4 43 hole (0.07" dia) plates, followed by 4 Kenics® elements then A 70 mesh screen with elements + screen repeated twice more and terminated with 4 Kenics® elements. | (20) 1046 | 33.2 | (25.1) — | 15 | Pulsing through 3d plate. Plug flow between 1st 4 plates. Channeling between 5th-8th plates and first 6 Kenics® elements. Screens refined syrup fragments to smaller size. Many striations and some syrup fragments after 16 elements. |
| 5-9-27 | Same as Test 4-9-27 | (20) 1046) | 42 | (19.6) — | — | No syrup fragments after 16 Kenics® elements, but many striations. Flow in elements was erratic, with some backflow due to settling syrup agglomerates. |

Study of the recorded observations for Tests 3-6-30 and 1-7-3 in TABLE III shows that the addition of perforated plates interspersed between Kenics® mixing elements provided more complete mixing than Kenics® elements alone.

A similar improvement in performance was noted in Tests 2-7-3 and 2-7-11 relative to Test 2-6-30 at a lower water rate.

The mixing superiority of multiple perforated plates over a single perforated plate is shown by comparision of the results of Tests 2-7-5 and 1-7-5.

Smaller 0.070 inch dia. holes provided better mixing than ⅛ inch dia. holes. Occasionally, the last Kenics® element effluent would show a water globule(Test 1a-8-3) when the larger holes were used, but never when the smaller 0.070 inch holes were used (Test 2-8-3).

When screens were disposed after the 4th, 8th and 12th Kenics® elements, the syrup fragments were reduced to a smaller size (Test 4-9-27). Also, a higher ratio of water to corn syrup could be tolerated. as shown by Tests 1-10-10, 3-10-10 and 2-10-18.

What is claimed is:

1. A method of mixing a low viscosity liquid with a high viscosity liquid where the proportion of said low viscosity liquid to said high viscosity liquid is in the volumetric flow ratio range of about 0.01 to 0.2, and where the ratio of viscosities of said high viscosity liquid to said low viscosity liquid is in the range of about $4 \times 10^3$ to about $10^6$ comprising introducing said low viscosity liquid under pressure into a flowing stream of said high viscosity liquid, thence flowing said liquids through a perforated plate establishing a multiplicity of wakes of said low viscosity liquid on the downstream side of said plate, and then impelling said low viscosity and said high viscosity liquids through a static mixing element.

2. A method of mixing a low viscosity liquid with a high viscosity liquid according to claim 1 wherein a plurality of said perforated plates are interposed ahead of said static mixing element.

* * * * *

UNITED STATES PATENT OFFICE
CERTIFICATE OF CORRECTION

PATENT NO. : 4,068,830

DATED : January 17, 1978

INVENTOR(S) : Joseph B. Gray

It is certified that error appears in the above-identified patent and that said Letters Patent are hereby corrected as shown below:

Col. 2, line 2 - "and" should read --end--.
Col. 2, line 50 - after "0.134 inch", insert -- ± 0.023 inch--.
Col. 3, line 34 - "hereinafter" should read --hereinbefore--.
Col. 5 and 6, between Tests 2-6-30 and 1-7-3, insert Test 3-6-30 data as set out on attached page "A".
Col. 5 , third line under Equipment re Test 1-7-3, after plate, insert --1/8"--.
Col. 5, third line under Equipment re Test 1-7-5, after plate, insert --1/8"--.
Col. 6, fifth line under Observations re Test 1-7-11, "after" should read --in--.
Col. 10, sixth line under Observations re Test 1-8-25, insert --striations after 16--.
Cols. 9 and 10, TABLE III, Delete all references to Tests 4-9-27 and 5-9-27 and insert data re Tests 1-10-10, 3-10-10 and 2-10-18 as set out on attached pages "A" and "B".

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*

TABLE III

| Test No. | Equipment | Syrup Temp (°C) Viscosity, poises | Per Cent Water in Effluent | Effluent Rate (lbs/hr) Viscosity, poises | Total Apparatus Pressure Drop, ΔP, p.s.i. | Observations |
|---|---|---|---|---|---|---|
| 1-10-10 | Four perforated plates having 85 0.070" holes each, separated 2" apart, followed by a 35 mesh screen, then 4 Kenics® elements, 1-60 mesh screen, then 4 Kenics® elements, 1-150 mesh screen, then 4 Kenics® elements, 1-270 mesh screen and, finally 4 Kenics® elements. | (17) | 43 | 40.0 | 37 | Some channeling in 4 to 8 Kenics® elements. Some syrup fragments after 16 elements. The screens aided reduction of fragment size. |

TABLE III (CONT'D)

| Test No. | Equipment | Syrup Temp (°C.) Viscosity, poises | Per Cent Water in Effluent | Effluent Rate (lbs/hr) Viscosity, poises | Total Apparatus Pressure Drop, ΔP, p.s.i. | Observations |
|---|---|---|---|---|---|---|
| 3-10-10 | Same | (17) | 69 | 68.5 | 27 | Channeling in 1st to 4th Kenics® elements. Water pulsing through 4th plate. In 5th to 8th elements water percolated through a bed of settled syrup fragments. No particles above 150 mesh screen. No striations after 16 Kenics® elements. |
| 2-10-18 | Same | (18) | 84 | 75 | 43 | Channeling through 2d plate, 1" bed of syrup fragments on 3d plate. No striations after 4 Kenics® elements. -- |